US005739495A

United States Patent [19]

Marin et al.

[11] Patent Number: 5,739,495

[45] Date of Patent: Apr. 14, 1998

[54] PUFFER-TYPE CIRCUIT BREAKER AND NOZZLE EMITTING GAS WITH COAXIAL ABUTTING PLASTIC TUBE

[75] Inventors: Heiner Marin, Berlin; Volker Lehmann, Treuenbrietzen, both of Germany

[73] Assignee: Siemens Aktiengesellschaft, Münich, Germany

[21] Appl. No.: 737,910

[22] PCT Filed: May 8, 1995

[86] PCT No.: PCT/DE95/00631

§ 371 Date: Nov. 26, 1996

§ 102(e) Date: Nov. 26, 1996

[87] PCT Pub. No.: WO95/33274

PCT Pub. Date: Dec. 7, 1995

[30] Foreign Application Priority Data

May 31, 1994 [DE] Germany ..... 44 20 386.1

[51] Int. Cl.[6] ..... H01H 33/985; H01H 33/915; H01H 33/78

[52] U.S. Cl. ..... 218/62; 218/63

[58] Field of Search ..... 218/43–78

[56] References Cited

U.S. PATENT DOCUMENTS

| | | | |
|---|---|---|---|
| 3,855,437 | 12/1974 | Goedecke et al. | 218/53 |
| 3,996,439 | 12/1976 | Tokuyama et al. | 218/62 |
| 4,163,131 | 7/1979 | Perkins | 218/65 |
| 4,786,770 | 11/1988 | Hamano et al. | 218/53 X |

FOREIGN PATENT DOCUMENTS

| | | | |
|---|---|---|---|
| 2532779 | 3/1984 | France | H01H 33/88 |
| 733282 | 3/1943 | Germany . | |
| 3822410 | 10/1989 | Germany | H01H 33/915 |
| 4111932 | 10/1992 | Germany | H01H 33/72 |

*Primary Examiner*—J. R. Scott

*Attorney, Agent, or Firm*—Kenyon & Kenyon

[57] ABSTRACT

A compressed-gas circuit breaker is provided with two contacts arranged coaxially opposite one another, at least one of which can be driven to move in the axial direction. The two contacts define in the interrupted state a contact gap. The circuit breaker also has a nozzle, made of insulating material, which is connected to the driven contact and which surrounds at least part of the contact gap. The invention calls for a high-strength plastic tube abutting coaxially against the outside of the insulating nozzle in order to prevent the nozzle from expanding radially as a result of an increase in arc-extinguishing gas pressure.

8 Claims, 1 Drawing Sheet

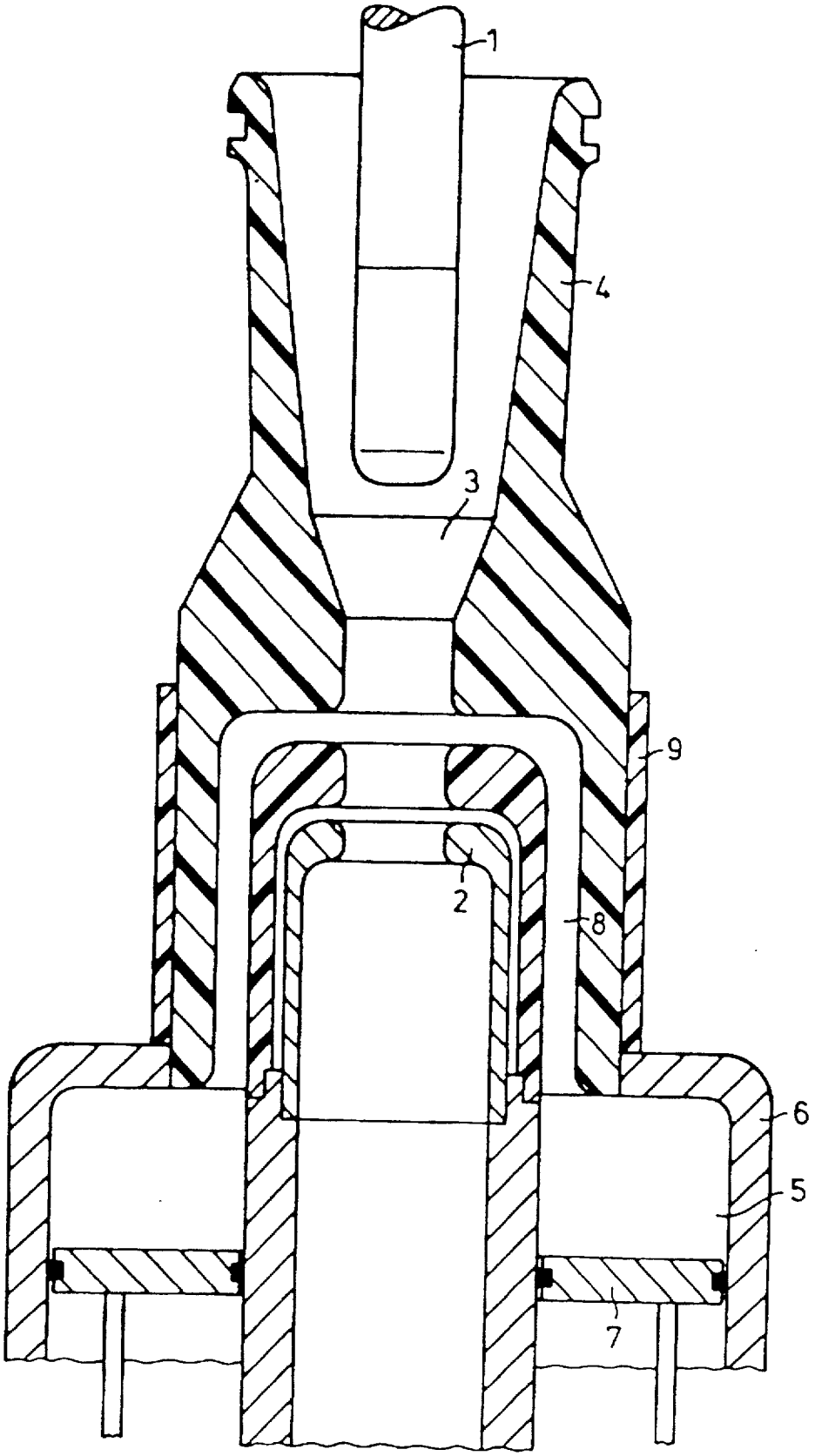
1
4
3
9
2
8
6
5
7

PUFFER-TYPE CIRCUIT BREAKER AND NOZZLE EMITTING GAS WITH COAXIAL ABUTTING PLASTIC TUBE

FIELD OF THE INVENTION

The present invention relates to a compressed-gas circuit breaker, particularly for high voltages, with two contacts arranged coaxially opposite one another, at least one of which can be driven to move in the axial direction, the two contacts defining in the interrupted state a contact gap, and with a nozzle, made of insulating material, which is connected to the driven contact and which surrounds at least part of the contact gap.

BACKGROUND OF THE INVENTION

Such a compressed-gas circuit breaker is known, for example, from U.S. Pat. No. 4,163,131.

In such an insulating nozzle switch circuit breaker, an intense pressure rise results after the separation of the contacts and the firing of an electric arc due to the heating up of an arc-extinguishing gas in the area of the contact gap, the pressure rise being used by means of the nozzle to achieve during the current zero crossing a blowout of the electric arc and thus a supporting of the extinguishing process.

With the increasing capacity of such high-voltage circuit breakers, the arc-extinguishing gas pressure becomes so intense in the area of the nozzle made of insulating material that the risk of an expansion of the nozzle member arises. This cannot be easily counteracted by producing the nozzle with a more stable material or with a greater wall strength since on the one hand the nozzle material itself is intended to release arc-extinguishing gas under the influence of the electric arc and on the other hand the arc-extinguishing gas nozzle with the drivable contact should be movable as quickly as possible, i.e., should have low mass, at least during the switching off.

OBJECTS AND SUMMARY OF THE INVENTION

The underlying object of the invention is to design a high-voltage circuit breaker of the type described in the introduction such that damage to the nozzle made of insulating material is avoided and nevertheless in this process the fastest possible switching speed is ensured. This objective is solved according to the invention by a high-strength plastic tube abutting coaxially against the outer circumference of the nozzle made of insulating material in its region exposed to the quencher gas pressure.

U.S. Pat. No. 4,786,770 discloses an insulating nozzle switch circuit breaker in which the nozzle made of insulating material is surrounded by a magnetic ring which is provided for the purpose of producing a magnetic field that lengthens the electric arc or allows it to rotate. Such a ring is heavy and accordingly difficult to accelerate. In the previously known switch, this does not entail any disadvantages since the nozzle made of insulating material is not joined to the drivable contact. There, the ring is also not provided for mechanical stabilization of the nozzle made of insulating material, but is provided only for magnetic reasons.

In contrast, the tube according to the invention stabilizes the nozzle made of insulating material against radial expansions due to the compressive loads produced by the expanding arc-extinguishing gas. The high-strength plastic tube does not have to consist of the same material as the nozzle made of insulating material since it does not come into contact with the electric arc and is also not intended to release any arc-extinguishing gas under the influence of the electric arc. Moreover, a less expensive material can be chosen than for the nozzle made of insulating material since the plastic tube has only mechanical stabilization duties and can be built correspondingly small. The plastic tube only needs to be large enough to brace the nozzle made of insulating material in the areas of particularly low wall strength.

The plastic tube can also be integrated into the nozzle member on its outer circumference so that it protrudes as little as possible over the outer contour. This increases the dielectric stability.

An advantageous refinement of the invention provides that the plastic tube consists of a fiber-reinforced plastic.

Such a fiber-reinforced plastic tube has a particularly high mechanical stability, particularly against expansion. Aramide fibers, fiberglass or plastic fibers can be provided as reinforcement fibers.

Moreover, it can be advantageously provided that the reinforcement fibers run in the circumferential direction of the plastic tube.

In this case, the reinforcement action is particularly effective against a radial expansion of the plastic tube.

Moreover, the invention can be advantageously developed in that the plastic tube is arranged in an area of the nozzle made of insulating material with decreased wall strength compared to other areas.

In this area, stabilization of the nozzle made of insulating material is particularly efficient, whereas it does not seem necessary in other regions in which the wall strength of the nozzle made of insulating material is already greater due to enlargements provided for reasons of flow engineering.

The plastic tube can also be advantageously adhered to the nozzle made of insulating material.

This results in a secure and gap-free connection between the nozzle made of insulating material and the plastic tube which ensures that, besides increased dielectric stability, even for variable thermal expansion or due to the constant shocks during switching operations, the plastic tube remains in its position on the nozzle made of insulating material. The plastic tube can also be advantageously shrunk on to the nozzle made of insulating material.

A further advantageous refinement of the invention provides that the nozzle made of insulating material is preloaded radially inwards by the plastic tube.

The nozzle made of insulating material then tolerates higher compressive loads in its inside particularly well since the preloading is not neutralized until an increased compressive load occurs and a neutral form of the nozzle made of insulating material is achieved. The nozzle made of insulating material thus withstands particularly high arc-extinguishing gas pressures.

It can also be advantageously provided that the plastic tube is manufactured through application of a fiber web to the nozzle made of insulating material and subsequent impregnation with an impregnating resin.

In this manner, the named plastic tube can be manufactured particularly simply and simultaneously joined securely to the nozzle made of insulating material.

BRIEF DESCRIPTION OF THE DRAWING

The invention is shown hereafter based on an exemplary embodiment in a drawing and subsequently described.

The FIGURE is a schematic longitudinal cross-section view of a circuit breaker with a nozzle made of insulating material.

DETAILED DESCRIPTION

The FIGURE shows a high-voltage circuit breaker having two contacts 1, 2 arranged coaxially opposite one another, of which the second contact 2 can be driven in a manner not shown. The circuit breaker is shown in the interrupted state. In the area of the contact gap 3 between the contacts 1, 2, an electric arc is drawn during the break procedure that heats up arc-extinguishing gas present there, particularly $SF_6$ and thus increases the arc-extinguishing gas pressure.

The nozzle 4 made of insulating material is securely joined to the movable contact 2 so that the nozzle moves with it during the break procedure.

In the area of the contact gap, the nozzle 4 made of insulating material defines in its interior an electric arc space, resulting in storage of hot arc-extinguishing gas under high pressure, that later flows back into the area of the electric arc during the current zero crossing of the current to be switched and contributes to extinguishing of the electric arc or rather a dielectric recovery of the contact gap 3.

This extinguishing effect is also supported by additional compressed arc-extinguishing gas that is made available in the compression space 5 by the switching motion between a compression cylinder 6 and a compression piston 7. The mechanically compressed arc-extinguishing gas can then flow via the channel 8 to the contact gap 3.

The nozzle 4 made of insulating material can be produced advantageously from PTFE (polytetrafluoroethylene) since this substance releases gases under the influence of an electric arc that support the extinguishing of the electric arc.

The nozzle 4 made of insulating material bears on its outside a plastic tube 9 made of fiber-reinforced plastic that is adhered to the nozzle made of insulating material. The plastic tube 9 extends over the area of the nozzle 4 made of insulating material in which it is designed with particularly thin walls.

In this manner, a radial expansion of the nozzle made of insulating material due to excessive arc-extinguishing gas pressure, e.g., due to a high current intensity to be switched, is avoided.

We claim:

1. A high-voltage compressed-gas circuit breaker, comprising:

two contacts arranged coaxially opposite one another, at least one of said contacts being driveable to move in an axial direction, said contacts defining a contact gap therebetween when in an interrupted state;

a nozzle made of insulating material, said nozzle being connected to the driveable contact, and said nozzle surrounding at least part of the contact gap; and a high-strength plastic tube coaxially positioned and abutting against an outer circumference of the nozzle at a region of the nozzle exposed to extinguishing gas pressure.

2. The high-voltage circuit breaker of claim 1, wherein the plastic tube comprises fiber-reinforced plastic.

3. The high-voltage circuit breaker of claim 2, wherein reinforcement fibers of the fiber-reinforced plastic extend in a circumferential direction of the plastic tube.

4. The high-voltage circuit breaker of claim 1, wherein the plastic tube is positioned in an area of the nozzle having decreased wall strength relative to other areas of said nozzle.

5. The high-voltage circuit breaker of claim 1, wherein the plastic tube is adhered to the nozzle.

6. The high-voltage circuit breaker of claim 1, wherein the plastic tube is shrunk onto the nozzle.

7. The high-voltage circuit breaker of claim 1, wherein the nozzle is preloaded radially inwards by the plastic tube.

8. The high-voltage circuit breaker of claim 1, wherein the plastic tube is manufactured through application of a fiber web to the nozzle and subsequent impregnation with an impregnating resin.

* * * * *